US008632056B1

(12) United States Patent
Roberts et al.

(10) Patent No.: US 8,632,056 B1
(45) Date of Patent: Jan. 21, 2014

(54) SAFETY RAIL SYSTEM

(76) Inventors: Michael L. Roberts, Las Vegas, NV (US); Jennifer Fritsch, Las Vegas, NV (US)

( * ) Notice: Subject to any disclaimer, the term of this patent is extended or adjusted under 35 U.S.C. 154(b) by 2 days.

(21) Appl. No.: 13/303,757

(22) Filed: Nov. 23, 2011

(51) Int. Cl.
*E04H 17/14* (2006.01)

(52) U.S. Cl.
USPC ..... 256/19; 256/59; 182/113

(58) Field of Classification Search
USPC ..... 256/19, 59, 65.01, 65.02, 65.14, 65.15; 403/292, 349; 182/113
See application file for complete search history.

(56) References Cited

U.S. PATENT DOCUMENTS

| | | | | |
|---|---|---|---|---|
| 221,449 | A | 11/1879 | DeWolfe | |
| 1,496,665 | A | 6/1924 | Fahrenholz | |
| 2,820,655 | A * | 1/1958 | Hileman | 403/349 |
| 3,406,946 | A | 10/1968 | Saultz | |
| 3,776,521 | A | 12/1973 | Weinert | |
| 3,901,481 | A | 8/1975 | Probst | |
| 4,830,341 | A | 5/1989 | Arteau et al. | |
| 4,946,138 | A * | 8/1990 | Gaillard et al. | 256/13.1 |
| 5,148,342 | A | 9/1992 | Kato | |
| 5,377,958 | A | 1/1995 | Palmer | |
| 5,400,870 | A * | 3/1995 | Inoue | 182/178.6 |
| 5,586,423 | A | 12/1996 | Mullen | |
| 6,015,139 | A | 1/2000 | Weber | |
| 6,585,080 | B2 | 7/2003 | Murray | |
| 6,745,529 | B2 | 6/2004 | Beltran | |
| 7,188,453 | B2 * | 3/2007 | Greenberg et al. | 52/223.7 |

* cited by examiner

*Primary Examiner* — Michael P Ferguson
*Assistant Examiner* — Daniel Wiley
(74) *Attorney, Agent, or Firm* — Robert C. Montgomery; Montgomery Patent & Design

(57) ABSTRACT

A modular, temporary safety railing system that provides fall restraint protection during masonry wall construction projects includes a plurality of anchoring sleeves which are embedded in wet grout within a hollow cavity of a masonry block onto which posts and rail sections are assembled. The embedded pins receive and secure respective vertical posts via interconnecting locking pins comprising spring pin fasteners. A plurality of top and intermediate rail sections are attached to the vertical posts using connecting hardware designed to adjustable position said rail sections at an offset distance allowing additional courses of block to be added to the wall without interference from said railing system. As construction continues, the vertical posts are detached from the embedded sleeves and reused with newly installed sleeves.

11 Claims, 5 Drawing Sheets

SAFETY RAIL SYSTEM

RELATED APPLICATIONS

There are currently no applications co-pending with the present application.

FIELD OF THE INVENTION

The present invention relates generally to a temporary handrail, and in particular, to a safety handrail system which serves as a fall restraint during construction of masonry walls.

BACKGROUND OF THE INVENTION

Safety rails and fall restraint products are known. While these restrain systems are effective, they may still allow for injury should a worker fall even a few feet. Temporary barricades and similar safety restraint systems used for elevated construction sites are time consuming to erect. Permanent fall restraints require noticeable modifications made to structures to guarantee safe anchoring. Additionally, restraint systems often hinder work and slow productivity.

Various attempts have been made to provide temporary handrails to masonry wall construction projects. Examples of these attempts can be seen by reference to several U.S. Pat. No. 3,776,521, issued in the name of Weinert, describes a portable safety railing for positioning upon preexisting horizontal surfaces with weighted bases.

U.S. Pat. No. 3,901,481, issued in the name of Probst, describes a barricade or railing for a roof upon a structure.

U.S. Pat. No. 5,188,342, issued in the name of Ouellette et al., describes a safety railing for the edge of a roof upon a structure.

While these attempts may fulfill their respective, particular objectives, each of these references suffer from one (1) or more disadvantages. Many are not suited to provide portable protection to workers erecting masonry walls at elevated heights. Others are limited and provide protection only to pre-existing roofing structures or other pre-existing horizontal structures.

SUMMARY OF THE INVENTION

The inventor has recognized the aforementioned inherent problems and lack in the art and observed that there is a need for a portable safety rail system which protects and accommodates the needs of workers erecting masonry walls at elevated heights.

Accordingly, it is an object of the present embodiments of the invention to solve at least one (1) of these problems. The inventor has addressed this need by developing a safety rail system that provides fall protection and restraint and that is adapted for use with the construction of masonry walls.

To achieve the above objectives, it is an object of the present invention to provide fall restraint protection during masonry wall construction projects.

Another object of the present invention is to provide tubular anchoring assemblies which comprise a bottom sleeve portion which is embedded within pre-cured liquid grout fill within hollow cavity portions of masonry blocks which make up a partially completed wall.

Yet still another object of the present invention is to provide a plurality of vertical posts which connect to the embedded sleeves via locking pins.

Yet still another object of the present invention is to provide a plurality of rail sections attached to the posts in a horizontal and offset manner using respective rail offset assemblies being positioned at top and intermediate positions along the posts.

Yet still another object of the present invention is to provide a sleeve and a locking pin which provide a stable means of attachment of the vertical posts to the masonry wall.

Yet still another object of the present invention is to provide a means to easily adjust the horizontal offset distance between the rail sections and the posts.

Yet still another object of the present invention is to provide an alternate anchor bolt assembly to support an alternate post to support the rail sections.

Yet still another object of the present invention is to provide a method of utilizing the device that provides a unique means of filling masonry blocks with grout fill, submerging sleeves, positioning sleeves, curing, inserting the locking pins, inserting the posts, assembling the rail sections, securing the threaded rods, reconfiguring the system with the increasing height of the masonry wall and, partially or completely eliminating the use of cables and/or safety harness equipment at a masonry wall project.

Further advantages of the embodiments disclosed in accordance with the present invention will become apparent from a consideration of the drawings and ensuing description.

Furthermore, the described features and advantages of the disclosure may be combined in various manners and embodiments as one skilled in the relevant art will recognize. The disclosure can be practiced without one (1) or more of the features and advantages described in a particular embodiment.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

| | |
|---|---|
| 10 | safety rail system |
| 12 | post |
| 13a | lower post aperture |
| 13b | upper post aperture |
| 16 | rail section |
| 17 | rail aperture |
| 30 | anchoring assembly |
| 32 | locking pin |
| 33 | locking pin aperture |
| 34a | lower spring pin |
| 34b | upper spring pin |

-continued

| | |
|---|---|
| 40 | sleeve |
| 42 | sleeve slot |
| 50 | rail offset assembly |
| 52 | threaded rod |
| 54 | nut fastener |
| 56 | wing nut |
| 58 | dimension 'C' |
| 70 | anchor bolt assembly |
| 72 | alternate post |
| 73 | fastener plate |
| 74 | anchor bolt |
| 75 | alternate aperture |
| 80 | masonry block |
| 82 | grout fill |
| 85 | masonry wall |

DETAILED DESCRIPTION OF THE PREFERRED EMBODIMENT

Figure 3:
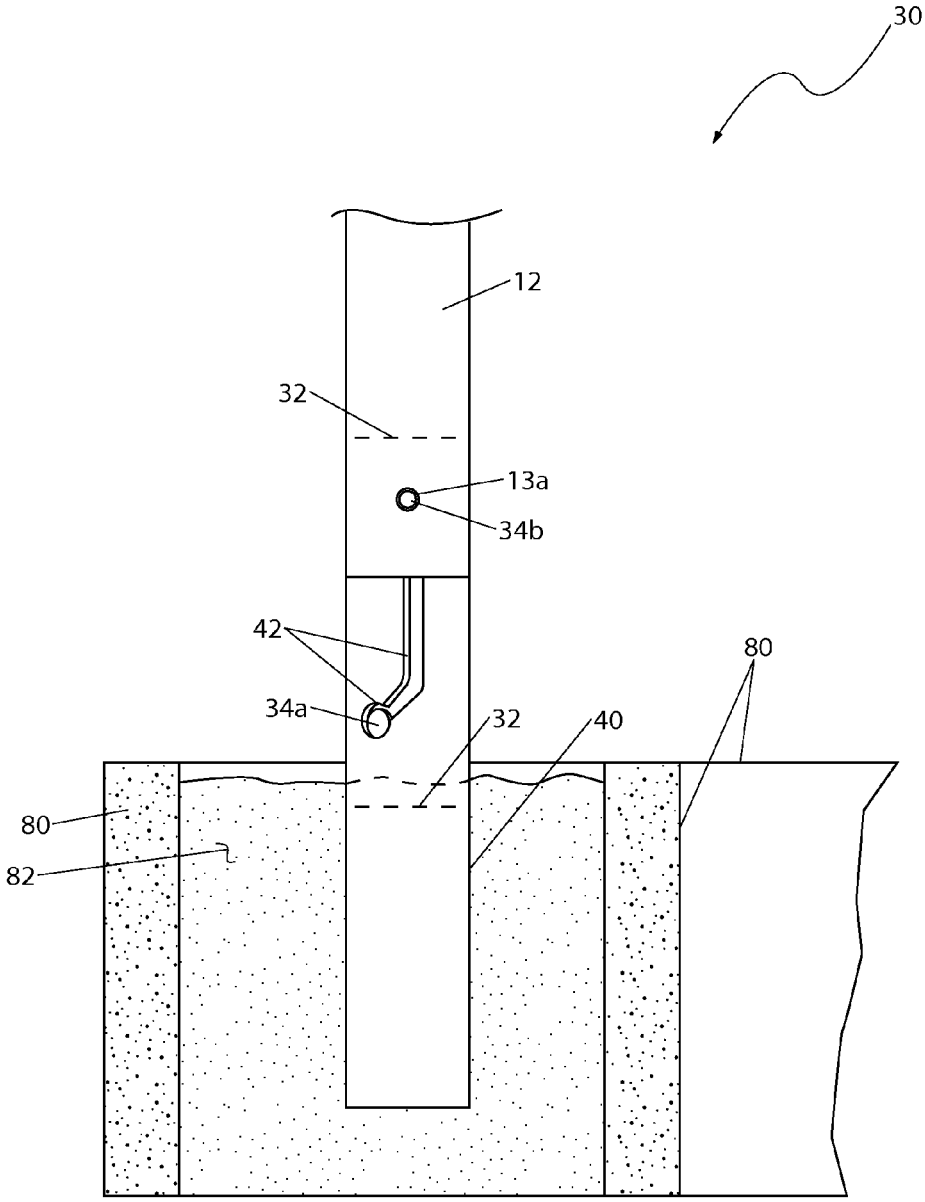
FIG. 3 is a side view of the anchoring assembly 30 in an in-use state, according to a preferred embodiment of the present invention.
Figure 4:
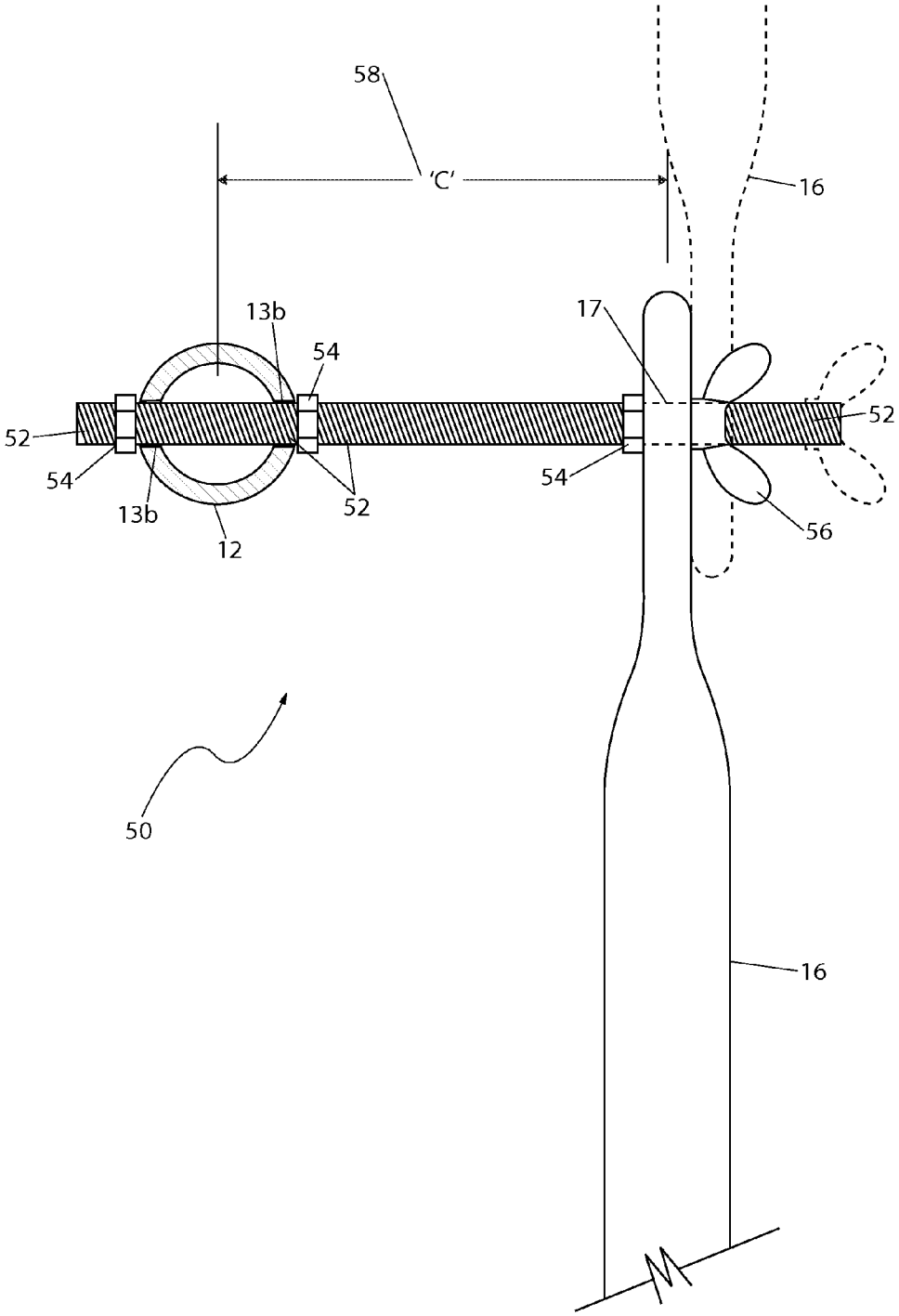
FIG. 4 is a is a top view of a rail offset assembly portion 50 of the safety rail system 10, according to a preferred embodiment of the present invention; and, FIG. 5 is an anchor bolt assembly 70, according to an alternate embodiment of the present invention.
Figure 5:
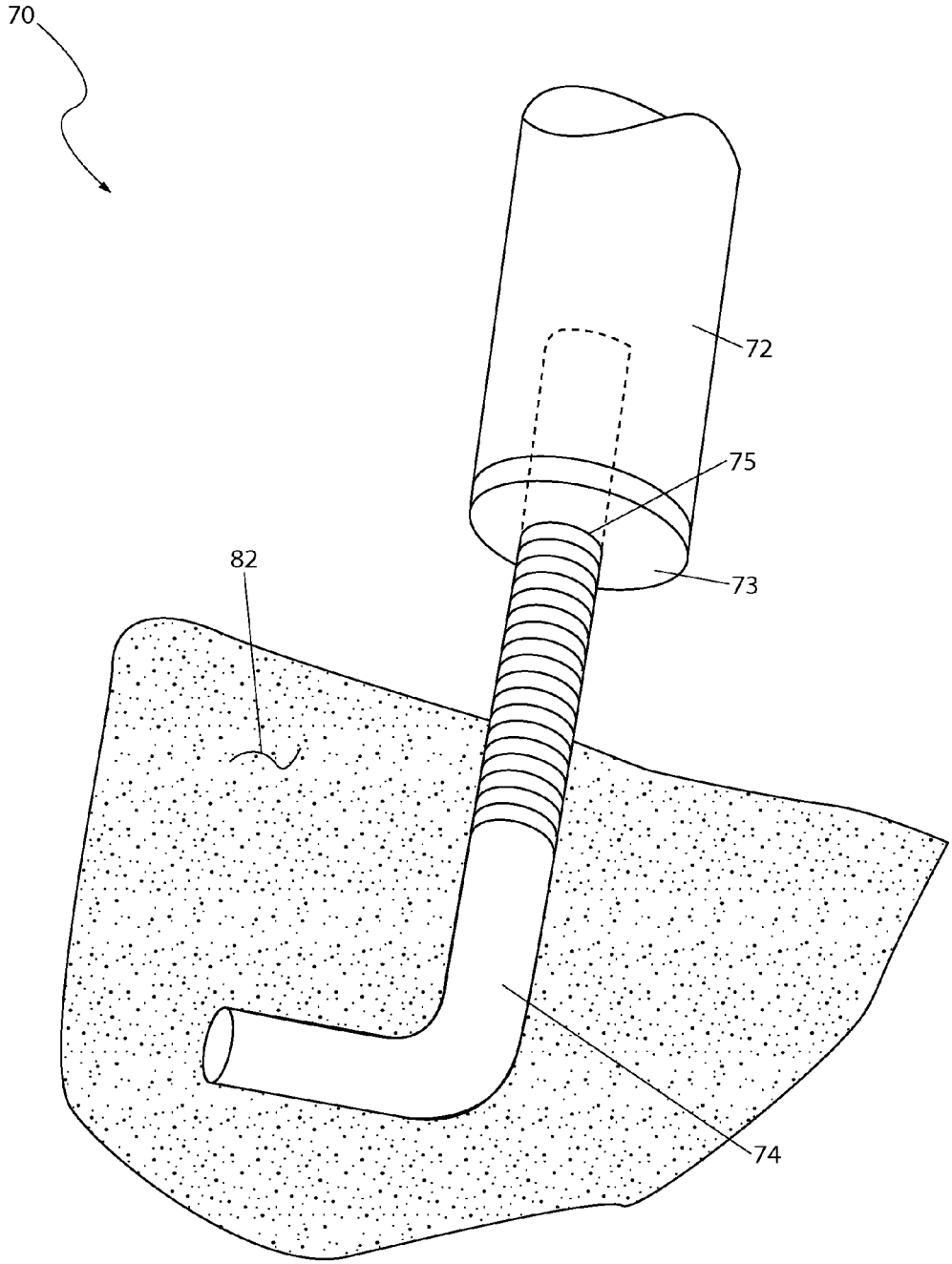

The best mode for carrying out the invention is presented in terms of its preferred embodiment, within FIGS. 1 through 4, and in terms of an alternate anchor bolt embodiment 70, herein depicted within FIG. 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
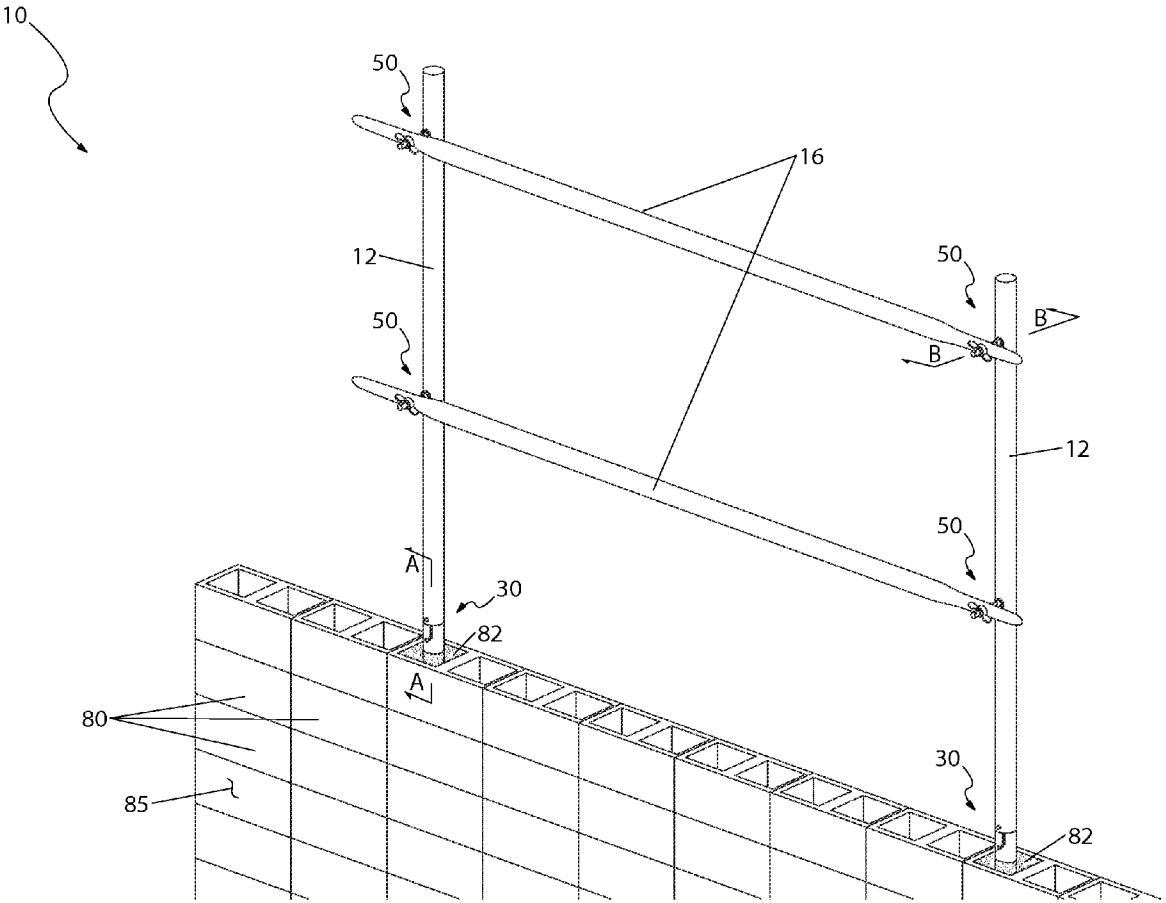
FIG. 1 is an environmental view of a safety rail system 10, according to a preferred embodiment of the present invention.

Referring now to FIG. 1, an environmental view of the system 10 (herein described as the "system") 10, which provides a temporary handrail means which serves as a fall restraint during a masonry wall 85 construction project. The system 10 comprises a plurality of tubular anchoring assemblies 30 which comprise a bottom sleeve portion 40 which is embedded within pre-cured liquid grout fill 82 within hollow cavity portions of masonry blocks 80 which make up a partially completed wall 85. The system 10 is envisioned to provide a beneficial safety feature when incorporated as part of a vertical wall 85 on an elevated construction project. The system 10 is primarily made up of commercially-available scaffolding components provided by manufacturers of such equipment such as, but not limited to: WTI BUILDING PRODUCTS®, C&J SCAFFOLDING SERVICE®, SCAFFOLDING MANUFACTURERS, LLC®, TAR SCAFFOLDING, INC.® and others. The sleeve portions 40 provide a secure foundation to the remaining portions of the system 10 and remain behind as construction of said wall 85 progresses upwardly. The system 10 further comprises a plurality of vertical posts 12 which connect to the embedded sleeves 40 via locking pins 32 (see FIGS. 2 and 3). A plurality of rail sections 16 are then attached to said posts 12 in a horizontal and offset manner using respective rail offset assemblies 50 being positioned at top and intermediate positions along said posts 12 in accordance with OSHA and other applicable regulations (see FIG. 4). The features of the system 10 are envisioned to partially or completely eliminate use of commonly used safety cables and safety harness equipment which are often difficult to implement and often hinder work progress.

The system 10 is shown here depicting a single assembled section; however, it is understood that each rail section 16 may comprise two (2) or more posts 12 based upon an overall spanning length, and that pairs of rail sections 16 may also be joined together as needed by being overlapped and fastened using the rail offset assemblies 50 to form a desired overall width of the system 10 based upon a particular masonry wall project (see FIG. 4).

Figure 2:
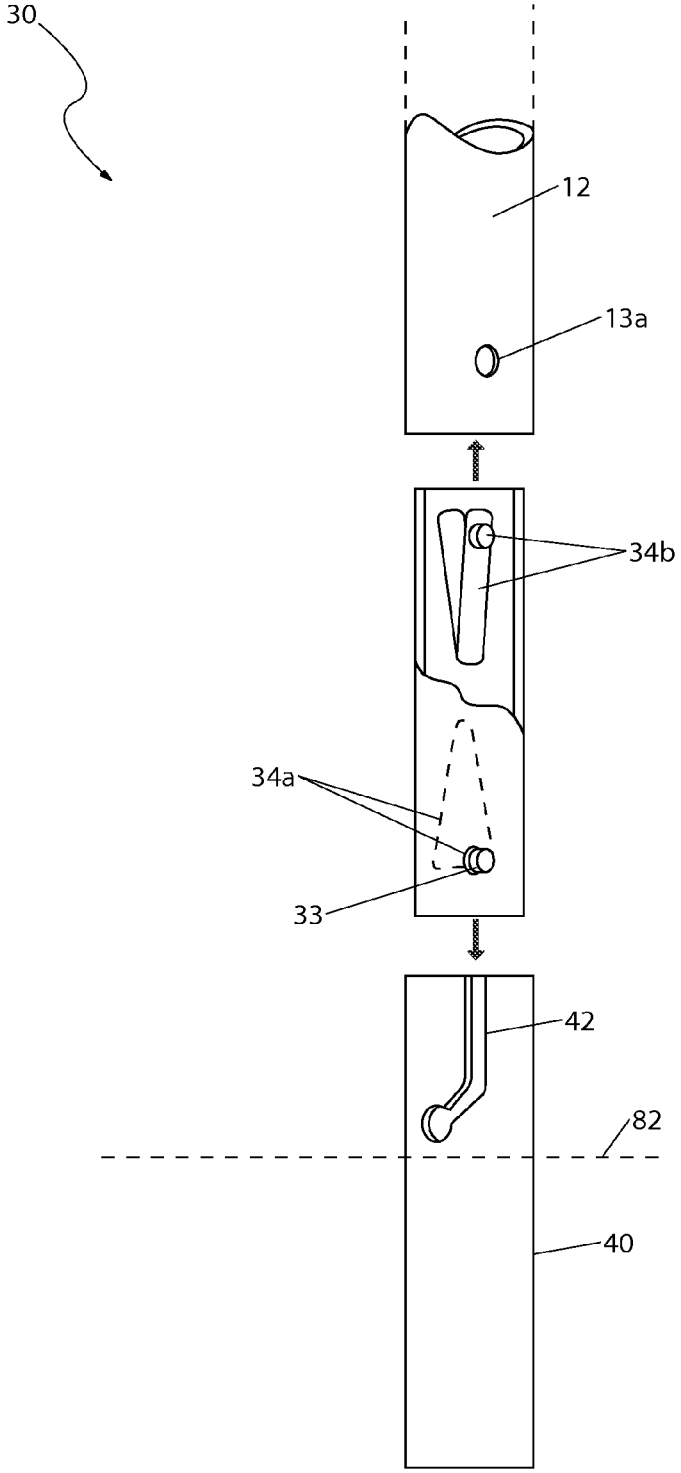
FIG. 2 is a close-up view of an anchoring assembly portion 30 of the safety rail system 10, according to a preferred embodiment of the present invention.

Referring now to FIGS. 2 and 3, close-up and in-use views of the anchoring assembly portion 30 of the system 10, according to a preferred embodiment of the present invention, are disclosed. Each anchoring assembly 30 comprises a sleeve 40 and a locking pin 32 which provide a stable means of attachment of the vertical posts 12 to the masonry wall 85. The inside diameters of the posts 12 and the sleeves 40 are identical and are sized so as to provide an inserting slip-fit of upper and lower end portions of each locking pin 32. The locking pin 32 comprises a hollow cylindrical commercially-available scaffolding component approximately ten (10) inches in length and is outfitted internally with a lower spring pin 34*a* and an upper spring pin 34*b*, each comprising a pair of round-nose pin portions mounted to a "V"-shaped spring, thereby providing easy digit-operated locking and releasing of each post 12 and sleeve 40 using respective lower post aperture 13*a* and opposing sleeve slot 42 portions.

In use, the sleeve 40 is embedded within pre-cured liquid grout fill 82 within the masonry block 80 such that the sleeve groove portion 42 of the sleeve 40 is positioned slightly above a top surface of the grout fill 82, thereby allowing detachment of the post 12 and locking pin 32 from said sleeve 40 to remove, raise, or otherwise reconfigure the post 12 and rail 16 portions of the system 10, as needed. The sleeve 40 is illustrated here depicting an "L"-shaped sleeve slot 42 which provides an "insert-and-twist" means to interlock the lower spring pin 43*a*; however, it is understood that the sleeve 40 may comprise different engagement methods such as a pair of round holes or other features which act to engage said spring pins 43*a*, without deviating from the teachings of the invention, and as such should not be interpreted as a limiting factor of the system 10.

Referring now to FIG. 4, a top view of a rail offset assembly portion 50 of the system 10, according to a preferred embodiment of the present invention, is disclosed. Each rail section 16 comprises an elongated center section with a pair of terminal flattened end portions each having a rail aperture 17 for receiving a threaded rod 52 and nut fasteners 54 for securing each rail section 16 at an offset position to an individual post 12 or to an adjacent rail section 16.

The rail offset assemblies 50 provide a means to easily adjust the horizontal offset distance 'C' 58 between the rail sections 16 and the posts 12, thereby obtaining the required clearance needed to add courses of masonry blocks 80 upwardly while retaining the safety benefit of the rail sections 16. Each rail offset assembly 50 further comprises a threaded rod 52 approximately one (1) foot in length, a plurality of nut fasteners 54, and a wing nut 56. Each threaded rod 52 is inserted through respective opposing upper post aperture portions 13*b* of each post 12 and secured using the nut fasteners 54. The remaining end of the threaded rod 52 is inserted through a rail aperture portion 17 of each rail section 16 and is secured in position using a nut fastener 54 along an inner surface, and a wing nut fastener 56 along an outer surface of said rail section 16. The wing nut fastener 56 enables a user to easily adjust the horizontal offset distance 'C' 58 between the rail sections 16 and the posts 12. The offset distance "C" 58 is based upon a thickness of a specific masonry wall 85 and corresponding clearance needed to add courses of masonry blocks 80 upwardly while retaining the position of the rail sections 16. The offset distance 'C' 58 of said rail sections 16 allows the addition of several courses of masonry block 80 until obtaining a height which necessitates reconfiguring of the system 10 to raise the height of the rail sections 16. It is understood that other devices such as drop locks or equivalent mechanical stop devices may be provided in lieu of said nut 54 and wing nut 56 fasteners to secure said rail sections 16 and/or posts 12 without deviating from the teachings of the invention, and as such should not be interpreted as a limiting factor of the system 10.

As seen here, additional rail sections 16 may be overlapped and joined using said nut 54 and wing nut 56 fasteners to form a desired length of the system 10.

Referring now to FIG. 5, an anchor bolt assembly 70, according to an alternate embodiment of the present invention, is disclosed. The alternate anchor bolt assembly 70 may be utilized in lieu of the previously described anchoring assembly 30 to support an alternate post 72 to support the rail sections 16, thereby providing support of said rail sections 16 in a similar manner as the previously described preferred posts 12. The alternate post 72 is envisioned to comprise a commercially-available scaffolding post having one (1) end portion being enclosed using a welded-in disc-shaped fastener plate 73 positioned along a horizontal plane and further comprising a central female threaded aperture portion 75. Said threaded aperture portion 75 of the fastener plate 73 is sized so as to threadingly receive a standard right-angle concrete anchor bolt portion 74 of the anchor bolt assembly 70. The anchor bolt 74 and alternate post 72 provide similar function as the previously described post 12 and sleeve 40. During assembly, the anchor bolt 74 would be embedded into the pre-cured liquid grout fill 82 within the block 80 with the threaded portion extending upwardly above a top surface of said grout fill 82. Following normal curing of the grout fill 82, the anchor bolt 74 is threadingly received into the fastener plate portion 73 of the alternate post 74. Finally, the rail sections 16 are to be assembled to said alternate posts 72 in a similar manner as the preferred posts 12.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: procuring individual piece parts from a manufacturer of scaffolding equipment required to assemble the system 10; filling a desired number of masonry blocks 80 with grout fill 82; submerging a respective number of sleeves 40 into pre-cured liquid grout fill 82 in locations where post portions 12 of the system 10 are to be positioned; positioning said sleeves 40 such that the sleeve groove portions 42 of each sleeve 40 are positioned slightly above a top surface of said grout fill 82; allowing a sufficient period of time for the grout fill 82 to cure; inserting the locking pins 32 into the sleeves 40 so as to engage the lower spring pin portions 34*a* of each locking pin 32 with the sleeve slot portions 42 of the sleeves 40; inserting the posts 12 onto said locking pins 32 so as to engage the upper locking pin portion 34*b* into respective lower post aperture portions 13*a* of each post 12; assembling the rail sections 16 at top and intermediate positions of each post 12 by inserting the threaded rods 52 through post aperture portions 17 such that said threaded rods 52 extend horizontally outward away from the masonry wall 85; securing said threaded rods 52 to the posts 12 using the nut fasteners 54; inserting the free end portions of each threaded rod 52 through respective rail aperture portions 17 of each respective rail section 16; positioning each rail section 16 along said threaded rods 52 at distance from the post portions 12 as represented by dimension 'C' 58 so as to provide sufficient vertical clearance for additional courses of masonry block 80 to be built upwardly upon the masonry wall 85; and, partially or completely eliminating the use cables and/or safety harness equipment at a masonry wall 85 project afforded a user of the present invention 10.

At such a time as the height of the masonry wall 85 necessitates raising and reconfiguring of the system 10 to reposition the rail sections 16, the system 10 would be reconfigured by performing the following steps: disengaging the posts 12 and rail sections 16 from the sleeves 40 by depressing the lower spring pin portions 34*a* of the locking pins 32 and lifting said assembled post 12 and rail 16 sections of the system 10 upwardly and setting said portions 12, 16 aside; adding a number of masonry blocks 80 so as to level the masonry wall 85 by filling gaps in said masonry wall 85 which were previously occupied by the post portions 12 of the system 10; filling said masonry blocks 80 with grout fill 82 and repeating the assembly process of the system 10 as described above at a superjacent elevation; and, repeating said upward reconfiguration of the system 10 as needed until completing the masonry wall 85 project.

The method of assembling the system 10 using the alternate anchor bolt assemblies 70 may be achieved by performing the following steps: embedding a desired number of anchor bolts 74 into the pre-cured liquid grout fill 82 within the blocks 80 in like manner as the previously described sleeves 40, with the threaded portions of said anchor bolts 74 extending vertically upwardly above a top surface of said grout fill 82; allowing a period of time for the grout fill 82 to cure; threadingly engaging the threaded aperture portion 75 of the fastener plates 73 of each alternate post 74 onto the respective anchor bolts 74; and, assembling the rail sections 16 to said alternate posts 72 in like manner as the previously described preferred posts 12.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A safety rail assembly, comprising:

a plurality of tubular anchoring assemblies, each comprising a slot and a sleeve portion having an upper end and a lower end;

a plurality of tubular posts, each having a first end comprising a first aperture and a second end having a pair of aligned second apertures;

a plurality of rail sections, each having a rail aperture located at opposing end portions thereof;

a plurality of fastening means for fastening said first end of one of said plurality of posts to one of said plurality of anchoring assemblies; and, a plurality of offset assemblies for removably fastening one of said plurality of rail sections to one of said plurality of posts, each comprising:

a threaded rod;

a pair of post nut fasteners removably fastened to said threaded rod;

a rail nut fastener removably fastened to said threaded rod; and, a wing nut removably fastened to said threaded rod;

wherein said plurality of anchoring assemblies each are placed within a portion of a wall and secured thereto;

wherein each of said plurality of fastening means is sized to correspondingly insert within an individual anchoring assembly and an individual post;

wherein an individual offset assembly fastens an individual rail section to an individual post at an offset distance;

wherein an individual offset assembly fastens an individual rail section to an adjacent rail section;

wherein said threaded rod is removably insertable within said pair of second apertures and said pair of post nut fasteners secures said threaded rod to said individual post;

wherein said rail nut fastener secures said threaded rod to a post side of said individual rail aperture and said wing nut secures said threaded rod to an outer side of said an individual rail aperture;

wherein said selective placement of said wing nut along said threaded rod enables selective horizontal adjustment of said offset distance;

wherein said offset distance is determined by a thickness of said wall and a clearance to add additional courses of said wall; and, wherein said safety rail assembly is adapted to be incorporated into said wall of a construction project.

2. The assembly of claim 1, wherein each of said plurality of fastening means further comprises a tubular sleeve locking pin insertable within said first aperture of said first end of said individual post and said slot located at said upper end of an individual anchoring assembly.

3. The assembly of claim 2, wherein said locking pin further comprises a lower spring pin insertable into said slot and an upper spring pin insertable into said first aperture, each comprising a pair of round-nose pin portions mounted to a "V"-shaped spring.

4. The assembly of claim 2, wherein said slot further comprises an angled slot to interlock said lower spring pin.

5. The assembly of claim 1, wherein each of said rail assemblies further comprises:

an elongated center section and a pair of flattened terminal end portions; and, said pair of rail apertures located at each of said pair of terminal end portions;

wherein each of said rail apertures correspondingly receive an individual offset assembly.

6. A safety rail assembly, comprising:

a plurality of tubular first anchoring assemblies, each comprising a sleeve having an upper end, a lower end, and a slot;

a plurality of tubular first posts, each having a first end comprising a first aperture and a second end having a pair of aligned second apertures;

a plurality of tubular second posts, each having a first end comprising an affixed disc-shaped fastener plate positioned along a horizontal plane thereof and further comprising a central third aperture and a second end having a pair of aligned fourth apertures;

a plurality of rail sections, each having a rail aperture located at opposing end portions thereof;

a plurality of fastening means for fastening said first end of one of said plurality of first posts to one of said plurality of anchoring assemblies;

a plurality of second anchoring assemblies; and, a plurality of offset assemblies for removably fastening one of said plurality of rail sections to one of said plurality of first posts or to one of said plurality of second posts, each comprising:

a threaded rod;

a pair of post nut fasteners removably fastened to said threaded rod;

a rail nut fastener removably fastened to said threaded rod; and, a wing nut removably fastened to said threaded rod;

wherein said plurality of first anchoring assemblies each are placed within a portion of a wall and secured thereto;

wherein each of said plurality of fastening means is sized to correspondingly insert within an individual anchoring assembly and an individual first post;

wherein said second anchoring assemblies each are placed within a portion of a wall and secured thereto;

wherein an individual second anchoring assembly is sized to correspondingly insert within an individual second post;

wherein an individual offset assembly fastens an individual rail section to said individual first post or said individual second post at an offset distance;

wherein an individual offset assembly fastens an individual rail section to an adjacent rail section;

wherein said threaded rod is removably insertable within said pair of second apertures and said pair of post nut fasteners secures said threaded rod to said individual first post;

wherein said threaded rod is removably insertable within said pair of fourth apertures and said pair of post nut fasteners secures said threaded rod to said individual second post;

wherein said rail nut fastener secures said threaded rod to a post side of said individual rail aperture and said wing nut secures said threaded rod to an outer side of said an individual rail aperture;

wherein said selective placement of said wing nut along said threaded rod enables selective horizontal adjustment of said offset distance;

wherein said offset distance is determined by a thickness of said wall and a clearance to add additional courses of said wall; and, wherein said safety rail assembly is adapted to be incorporated into said wall of a construction project.

7. The assembly of claim 6, wherein each of said plurality of fastening means further comprises a tubular sleeve locking pin insertable within said slot of said first end of said individual first post and said slot located at said upper end of an individual first anchoring assembly.

8. The assembly of claim 7, wherein said locking pin further comprises a lower spring pin insertable into said slot and an upper spring pin insertable into said first aperture, each comprising a pair of round-nose pin portions mounted to a "V"-shaped spring.

9. The assembly of claim 7, wherein said slot further comprises an angled slot to interlock said lower spring pin.

10. The assembly of claim 6, wherein each of said rail assemblies further comprises:

an elongated center section and a pair of flattened terminal end portions; and, said pair of rail apertures located at each of said pair of terminal end portions;

wherein each of said rail apertures correspondingly receive an individual offset assembly.

11. The assembly of claim 6, wherein said plurality of second anchoring assemblies each further comprises a right-angle anchor bolt with a threaded portion;

wherein said threaded portion correspondingly mates with said third aperture of said individual second post.

* * * * *